US008092045B2

(12) United States Patent
Xiao et al.

(10) Patent No.: US 8,092,045 B2
(45) Date of Patent: Jan. 10, 2012

(54) LED ILLUMINATOR

(75) Inventors: Xin-Jian Xiao, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 267 days.

(21) Appl. No.: 12/512,951

(22) Filed: Jul. 30, 2009

(65) Prior Publication Data

US 2010/0265710 A1 Oct. 21, 2010

(30) Foreign Application Priority Data

Apr. 20, 2009 (CN) ..... 2009 1 0301681

(51) Int. Cl.
*F21V 29/00* (2006.01)

(52) U.S. Cl. ..... 362/249.02; 362/800; 362/249.11; 362/646; 362/294

(58) Field of Classification Search ..... 362/249.02, 362/249.11, 800, 294, 373, 646
See application file for complete search history.

(56) References Cited

U.S. PATENT DOCUMENTS

| | | | | |
|---|---|---|---|---|
| 7,226,189 | B2 * | 6/2007 | Lee et al. | 362/294 |
| 7,401,945 | B2 * | 7/2008 | Zhang | 362/249.01 |
| 7,588,351 | B2 * | 9/2009 | Meyer | 362/294 |
| 7,670,029 | B1 * | 3/2010 | Luo et al. | 362/294 |
| 7,744,251 | B2 * | 6/2010 | Liu et al. | 362/294 |
| 7,800,119 | B2 * | 9/2010 | He et al. | 257/79 |
| 7,862,195 | B2 * | 1/2011 | Stack et al. | 362/125 |
| 7,862,204 | B2 * | 1/2011 | Lodhie | 362/249.02 |
| 2006/0109662 | A1 * | 5/2006 | Reiff et al. | 362/373 |

* cited by examiner

*Primary Examiner* — Anabel Ton
(74) *Attorney, Agent, or Firm* — Altis Law Group, Inc.

(57) ABSTRACT

An LED illuminator includes a connecting member, a lamp cover, a hollow lamp cap, a plurality of LEDs received in the lamp cover, and a sealing member. The connecting member is a hollow cylinder. The lamp cover couples to and seals a first end of the connecting member. The lamp cap has a top end coupling to a second end of the connecting member opposite the first end and a bottom end defining an aperture. The sealing member defines an annular slot in an outer circumferential surface, with a diameter not smaller than that of the aperture. A portion of the bottom end of the lamp cap around the aperture engages into the slot of the sealing member. A channel extends through the sealing member with a diameter not larger than a conductive wire.

18 Claims, 7 Drawing Sheets

LED ILLUMINATOR

BACKGROUND

1. Technical Field

The disclosure generally relates to illuminators and, particularly, to an illuminator incorporating light emitting diodes (LEDs) as light source.

2. Description of Related Art

LED has an advantage that it is resistant to shock, and has an almost eternal lifetime under a specific condition. Thus LED illuminators incorporating LEDs as a light source intend to be a cost-effective yet high quality replacement for incandescent and fluorescent lamps, particularly in wild fields, such as street lamps, submarine lamps, billboard lamps, and traffic lights. However, in the wild fields, rainwater, moisture, etc., significantly influence a reliability and a lifespan of the LEDs of the LED illuminator.

For the foregoing reasons, therefore, there is a need in the art for an LED illuminator which overcomes the limitations described.

DETAILED DESCRIPTION

Figure 1:
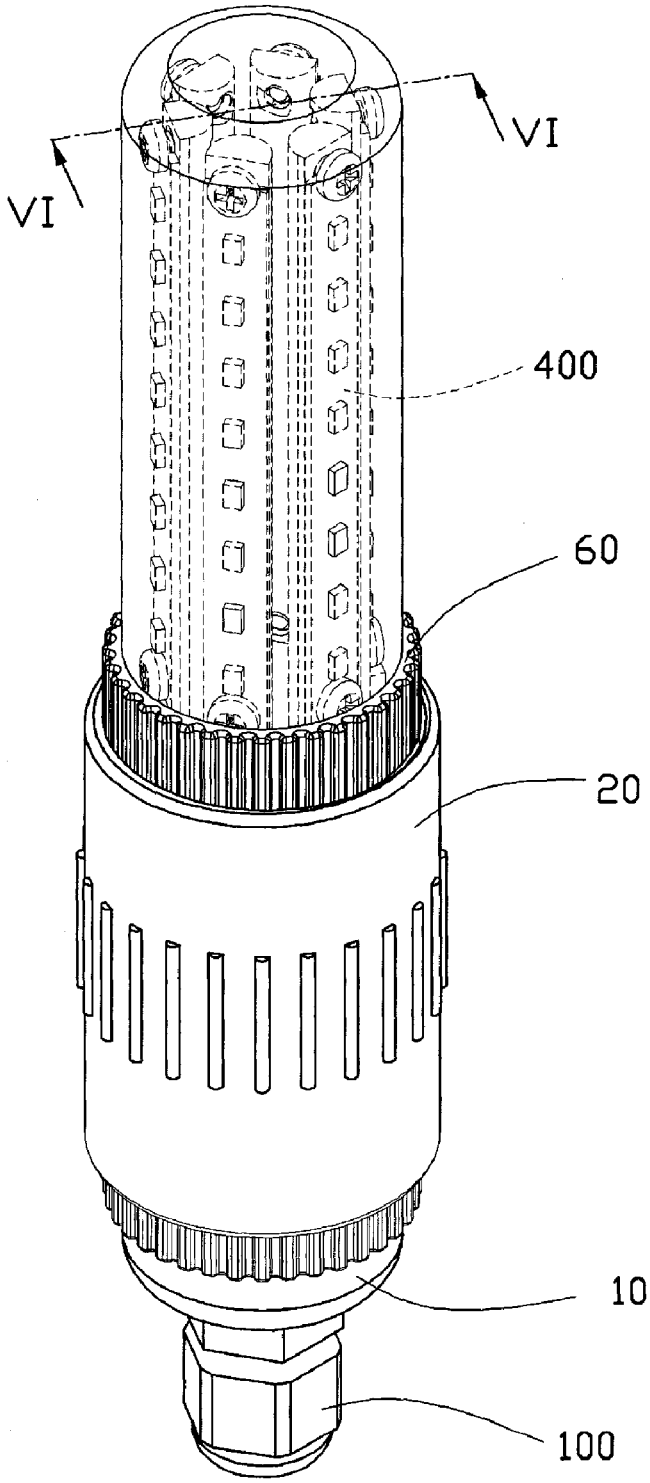
FIG. 1 is an isometric, assembled view of an LED illuminator according to an exemplary embodiment.

Referring to FIG. 1, an LED illuminator according to an exemplary embodiment includes a lamp cap 10, a connecting member 20, a light engine 400, a lamp cover 60, and a sealing member 100.

Figure 2:
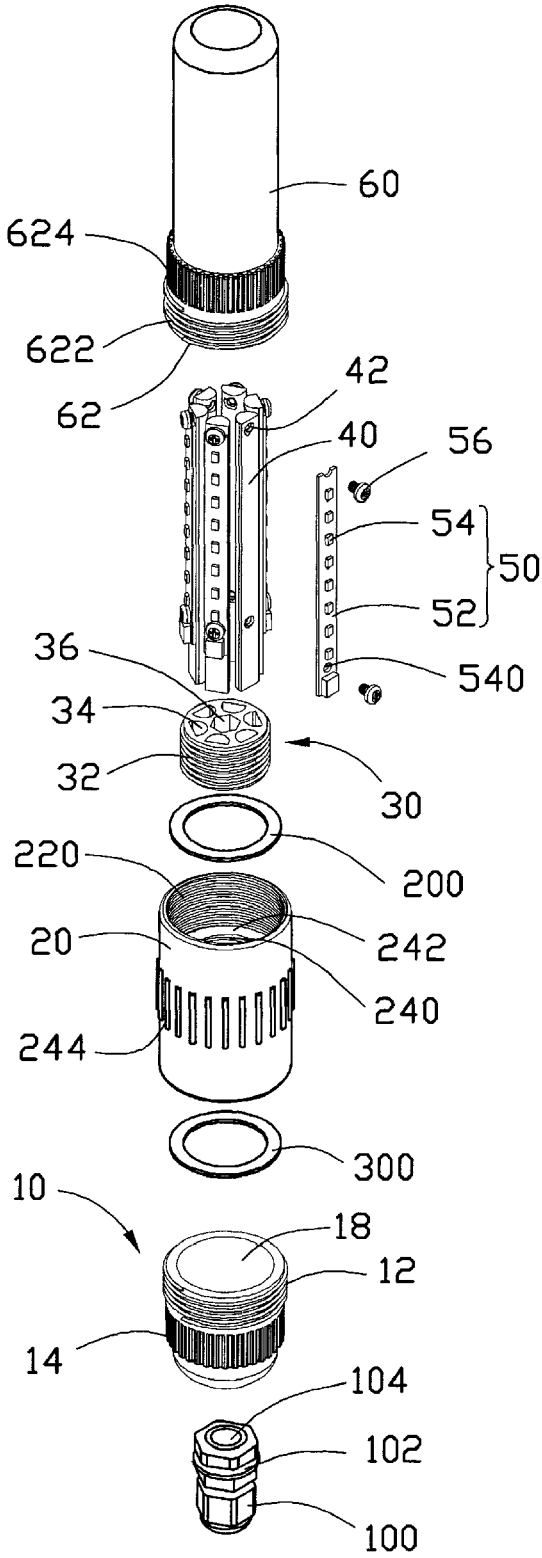
FIG. 2 is an exploded view of the LED illuminator of FIG. 1.
Figure 3:
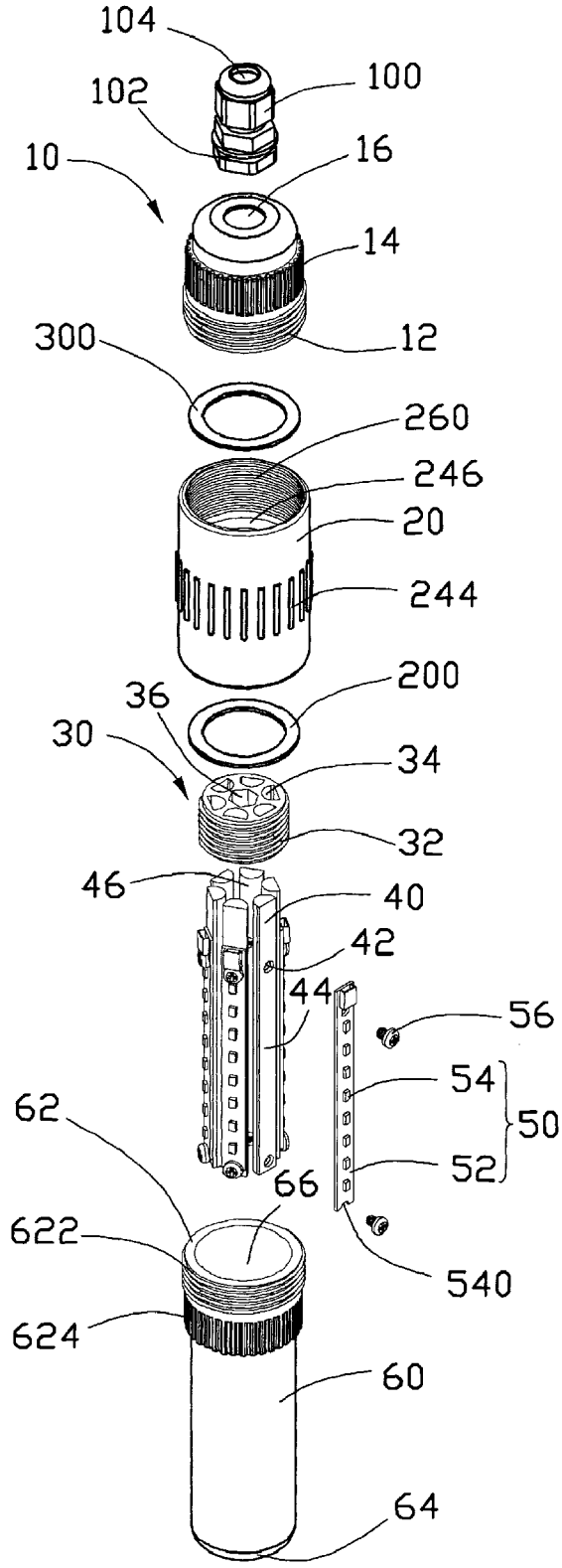
FIG. 3 is similar to FIG. 2, but shows the LED illuminator viewed from a bottom aspect.
Figure 5:
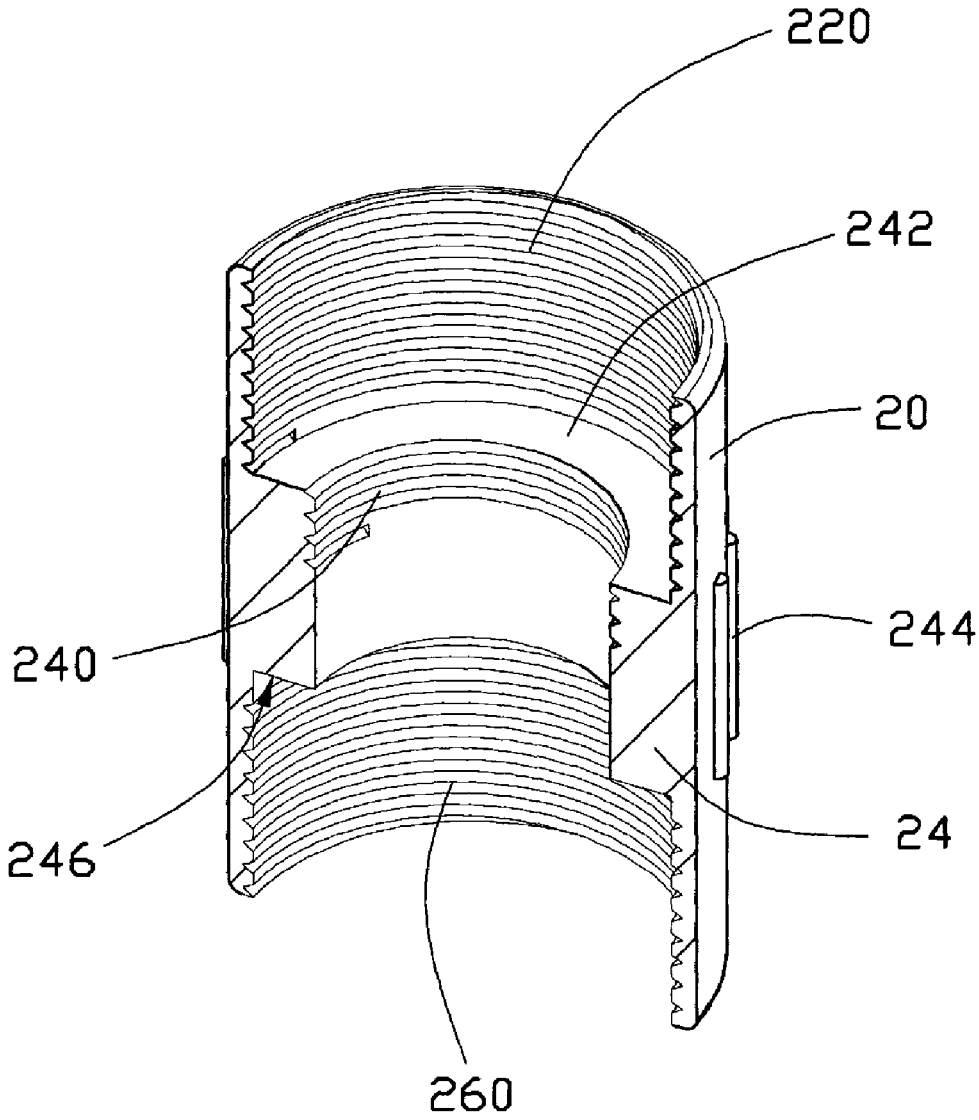
FIG. 5 is an axially cross-sectional view of a connecting member of the LED illuminator of FIG. 1.

Referring to FIGS. 2, 3 and 5, the connecting member 20 is cylindrical-shaped, and hollow. The connecting member 20 is made of metal or alloy which has a high heat conductivity coefficient, such as aluminum, aluminum alloy, copper or copper alloy. A plurality of fins 244 are integrally formed on an outer circumferential surface of the connecting member 20. Each of the fins 244 extends along an axial direction of the connecting member 20 with a length thereof being smaller than a length of the connecting member 20. The fins 244 are evenly distributed along a circumferential direction of the connecting member 20, and are substantially arranged at a middle of the connecting member 20 in the axial direction.

An annular protrusion 24 extends radially and inwardly from an inner circumferential surface of the connecting member 20. The protrusion 24 is located at the middle of the connecting member 20, which corresponds to a position of the fins 244. A height of the protrusion 24 in the axial direction substantially equals to the length of the fins 244. An upper step 242 is formed at a top side of the protrusion 24 for supporting the lamp cover 60 thereon, and a lower step 246 is formed at a bottom side of the protrusion 24. Both of the upper step 242 and the lower step 246 are flat, and annular. An internal thread 240 is formed at an inner circumferential surface of the protrusion 24 which is located between inner peripheries of the upper step 242 and the lower step 246. A first inner thread 220 is formed at a top portion of the inner circumferential surface of the connecting member 20 above the protrusion 24, and a second inner thread 260 is formed at a bottom portion of the inner circumferential surface of the connecting member 20 below the protrusion 24.

Figure 4:
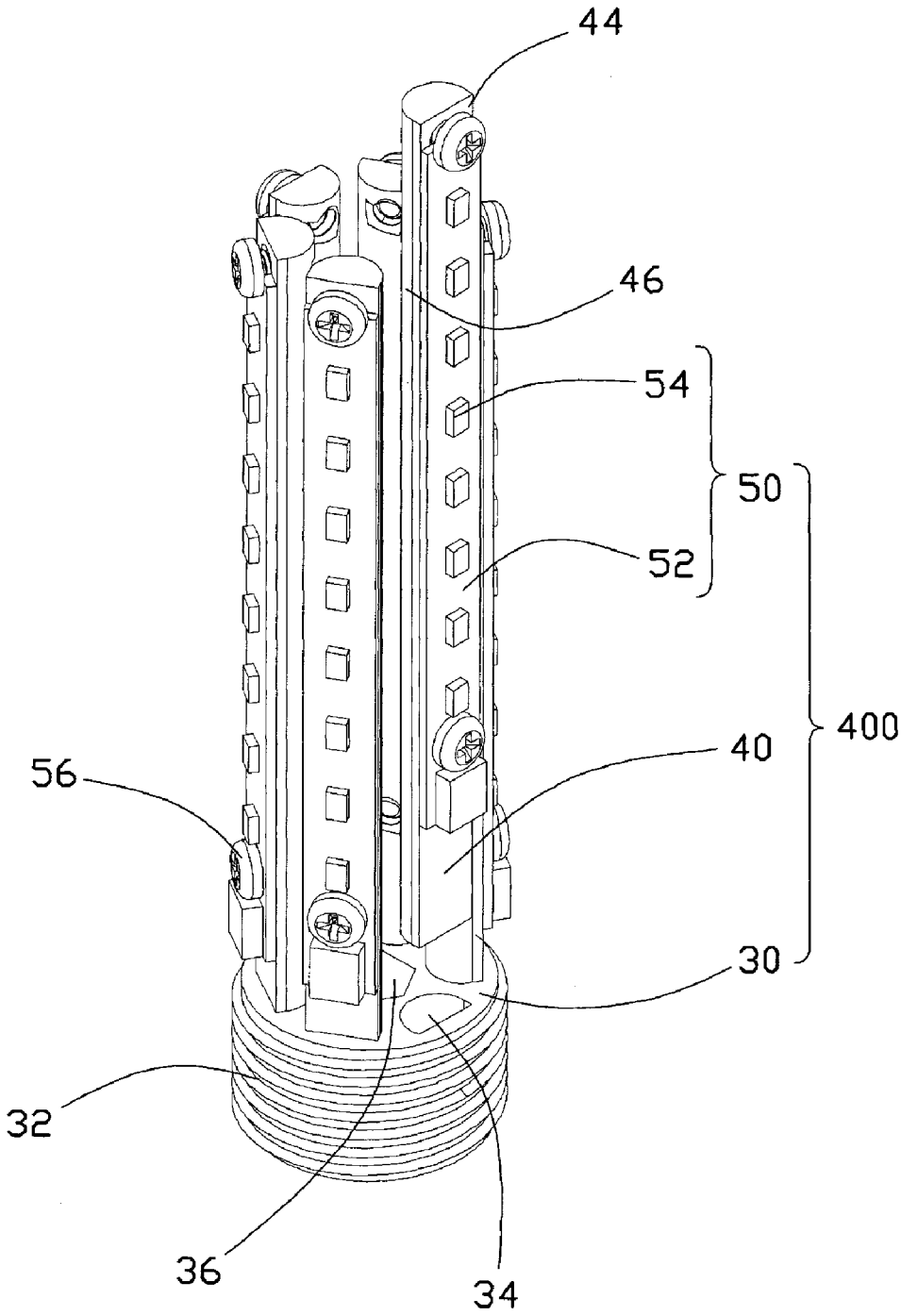
FIG. 4 shows a light engine of the LED illuminator of FIG. 1 being partly assembled.

Referring to FIGS. 2, 3 and 4, the light engine 400 includes a mounting seat 30, a plurality of heat spreaders 40, and a plurality of light sources 50. In this embodiment, there are six heat spreaders 40 and six light sources 50. Nevertheless, the number of the light sources 50 and the heat spreaders 40 is not limited to six. Each light source 50 includes a circuit board 52 and a plurality of LEDs 54. The circuit board 52 is elongated and flat. A pair of through holes 540 are respectively defined at top and bottom ends of the circuit board 52. The plurality of LEDs 54 are fixed on and electrically connected to the circuit board 52. The LEDs 54 are located between the pair of through holes 540 and spaced from each other with a constant distance.

The heat spreaders 40 are usually made of copper, which can absorb heat of the LEDs 54 timely. It is understood by a person skilled in the art that the heat spreaders 40 can be made of other materials having a high heat conductivity coefficient, such as aluminum. The heat spreaders 40 each are elongated and arranged vertically. A length of the heat spreader 40 is larger than that of the circuit board 52. A pair of engaging holes 42 are respectively defined adjacent to top and bottom ends of the heat spreader 40 corresponding to the through holes 540 of the circuit board 52. The heat spreader 40 has a semicircular cross section, and includes a flat mounting surface 44 for mounting the light source 50 thereon and an arc-shaped dissipating surface 46.

When the light source 50 is assembled, the circuit board 52 is arranged on the mounting surface 44 of the corresponding heat spreader 40 with the LEDs 54 facing an outside of the LED illuminator. The top end of the circuit board 52 is substantially at the same level as the top end of the heat spreader 40, whilst the bottom end of the heat spreader 40 is lower than the bottom end of the circuit board 52. Thus the bottom end of the heat spreader 40 is exposed for engaging with the mounting seat 30. The through holes 540 of the circuit board 52 are aligned with the engaging holes 42 of the heat spreader 40, respectively. Screws 56 respectively extend through the through holes 540 of the circuit board 52 to engage into the engaging holes 42 of the heat spreader 40 to assemble the circuit board 52 with the LEDs 54 fixed thereon onto the heat spreader 40 to from the light engine 400.

The mounting seat 30 is made of copper or aluminum, and is column-shaped. A diameter of the mounting seat 30 substantially equals to a diameter of the inner circumferential surface of the protrusion 24 of the connecting member 20. An external thread 32 is formed on an outer circumferential surface of the mounting seat 30 corresponding to the internal thread 240 of the protrusion 24 of the connecting member 20. An opening 36 is defined in a central portion of the mounting seat 30 and extends through the mounting seat 30 along an axial direction thereof. The opening 36 is configured for conductive wire extending therethrough to connect the LEDs 54 of the light sources 50 to an external power source.

Six grooves 34 extend through the mounting seat 30 along the axial direction. The six grooves 34 are located around the opening 36, and are evenly spaced from each other along a circumferential direction of the mounting seat 30. Each groove 34 has a cross section being semicircular, which is the same as that of the heat spreader 40. A size of the cross section of the groove 34 is a little smaller than that of the heat spreader 40. When the light sources 50 are assembled to the mounting seat 30, the bottom ends of the heat spreaders 40 are respectively interferentially inserted into the corresponding grooves 34 with the LEDs 54 of the light sources 50 facing the outside. Since the size of the grooves 34 are slightly smaller than that of the heat spreaders 40, an interference fit is formed between each of the light sources 50 and the mounting seat 30, which means that the light sources 50 are securely fixed on the mounting seat 30 to form the light engine 400.

The lamp cover 60 is made of transparent material. The lamp cover 60 is cylindrical-shaped, and hollow. A receiving space 66 is defined in the lamp cover 60 for receiving the light sources 50 therein. Light of the LEDs 54 of the light sources 50 can radiate through the lamp cover 60 to illuminate the outside. The lamp cover 60 forms an open end 62 at a bottom thereof and an opposite closed end 64 at a top thereof. A first outer thread 622 is formed on an outer circumferential surface of the lamp cover 60 at the open end 62 corresponding to the first inner thread 220 of the connecting member 20. A plurality of first ribs 624 are formed on the outer circumferential surface of the lamp cover 60 and located adjacent to and above the first outer thread 622 for facilitating assembly of the lamp cover 60 to the connecting member 20.

The lamp cap 10 is substantially hollow for receiving a driving module (not shown) therein which can provide drive power, control circuit and power management for the LEDs 54 of the light sources 50. A cross section of the lamp cap 10 along the axial direction of the LED illuminator is generally U-shaped. A first aperture 18 is defined at a top end of the lamp cap 10 adjacent to the connecting member 20, and a second aperture 16 is defined at a bottom end of the lamp cap 10 away from the connecting member 20. The second aperture 16 has a diameter smaller than that of the first aperture 18. A second outer thread 12 is formed on an outer circumferential surface of the lamp cap 10 at the top end of the connecting member 20 corresponding to the second inner thread 260 of the connecting member 20. A plurality of second ribs 14 are formed on the outer circumferential surface of the lamp cap 10 adjacent to and below the second outer thread 12 for facilitating assembly of the lamp cover 60 to the connecting member 20.

The sealing member 100 is made of plastic, and is provided for sealing the second aperture 16 of the connecting member 20. The sealing member 100 is substantially column-shaped. An annular slot 102 is defined in an outer surface of the sealing member 100. A diameter of the sealing member 100 at a position corresponding to the annular slot 102 slightly larger than the diameter of the second aperture 16 of the lamp cap 10. A channel 104 is defined in the sealing member 100, and extends through the sealing member 100 along an axial direction of the sealing member 100. The channel 104 is narrow, with a diameter not larger than the conductive wire which extends through the sealing member 100, the lamp cap 10, the connecting member 20 and the mounting seat 30 to connect the light sources 50 to the external power source. Thus, the sealing member 100 can effectively prevent foreign articles, such as dust or rainwater from entering the LED illuminator by moving along the conductive wire through the channel 104.

Figure 6:
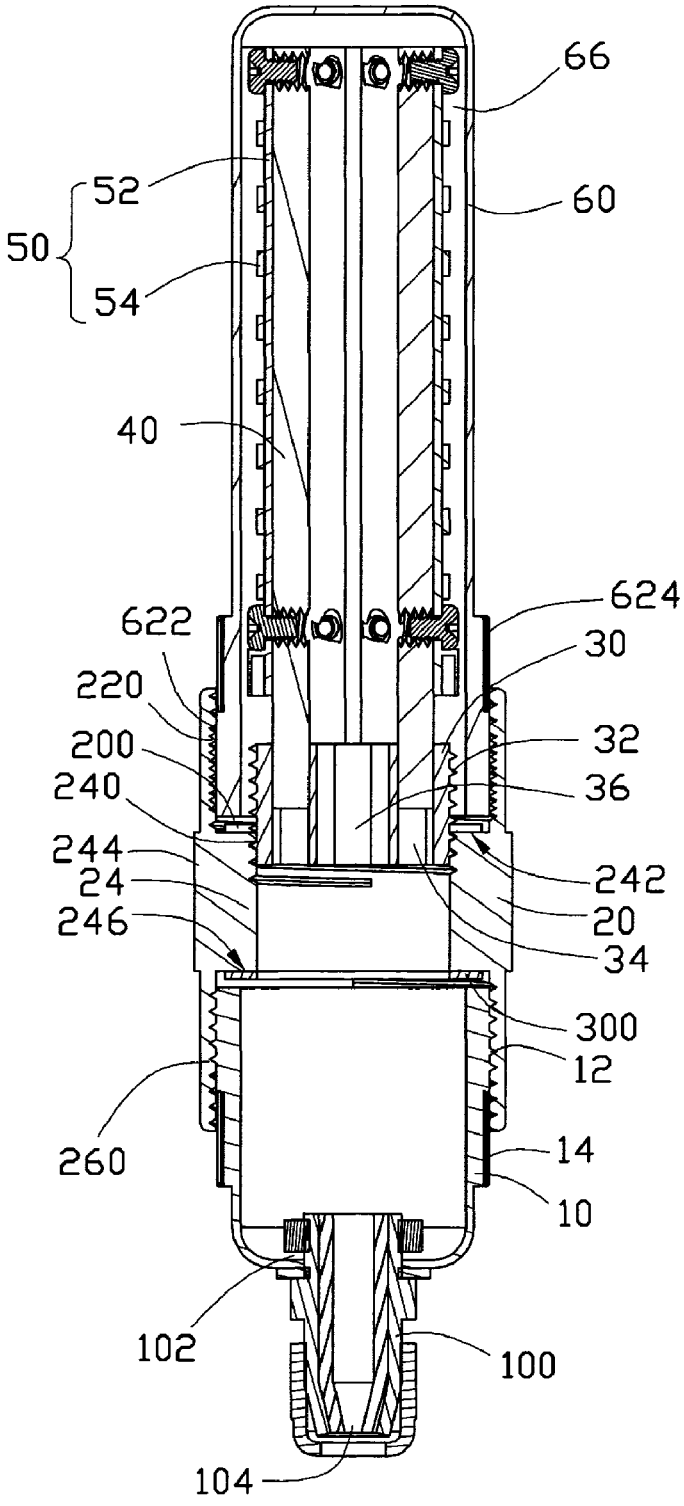
FIG. 6 is an axially cross-sectional view of the LED illuminator, taken along line VI-VI of FIG. 1.

Referring to FIG. 6, when the LED illuminator is assembled, firstly, the light engine 400 is mounted to the connecting member 20 with the mounting seat 30 being inserted into and threadedly engaged with the protrusion 24 of the connecting member 20. The lamp cover 60 is arranged at a top end of the connecting member 20 with the first outer thread 622 thereof threadedly engaging with the first outer thread 622 of the connecting member 20. A first sealing ring 200 is arranged between the bottom end of the lamp cover 60 and the upper step 242 of the protrusion 24 of the connecting member 20 to form a hermetical sealing between the lamp cover 60 and the connecting member 20. The light sources 50 thus are received in the receiving space 66 of the lamp cover 60. The lamp cap 10 is arranged at a bottom end of the connecting member 20 with the second outer thread 12 thereof threadedly engaging with the second inner thread 260 of the connecting member 20. A second sealing ring 300 is arranged between the top end of the lamp cap 10 and the lower step 246 of the protrusion 24 of the connecting member 20 to form a hermetical sealing between the lamp cap 10 and the connecting member 20.

The sealing member 100 is inserted into the lamp cap 10 with a portion of the bottom end of the lamp cap 10 around the second aperture 16 engaging into the annular slot 102 of the sealing member 100. The conductive wire extends through the channel 104 to the outside for connecting the external power source to supply electric current to the LEDs 54. Since the sealing member 100 at the annular slot 102 is slightly larger and not smaller than the second aperture 16 of the lamp cap 10, the bottom end of the lamp cap 100 is tightly sealed by the sealing member 100. In addition, since the channel 104 of the sealing member 100 is not larger than the conductive wire, the channel 104 is sealed by the conductive wire of the LED illuminator. Thus the LEDs 54 of the present LED illuminator are kept from environmental harm and mechanical damage, such as rainwater, which can significantly improve a reliability and a lifespan of the present LED illuminator.

During operation of the present LED illuminator, when the current is supplied to the LEDs 54 to cause the LEDs 54 to give off light, heat is also produced. Since the heat spreader 40, the mounting seat 30 and the connecting member 20 are made of high conductive material, the heat of the LEDs 54 can be timely conducted to the connecting member 20 for dissipation. The fins 244 on the connecting member 20 increase a heat exchanging area of the connecting member 20, thereby enhancing a heat dissipation efficiency of the connecting member 20. The LEDs 54 thus can be maintained working at a lower temperature. Accordingly, the reliability and lifespan of the present LED illuminator are further enhanced.

Figure 7:
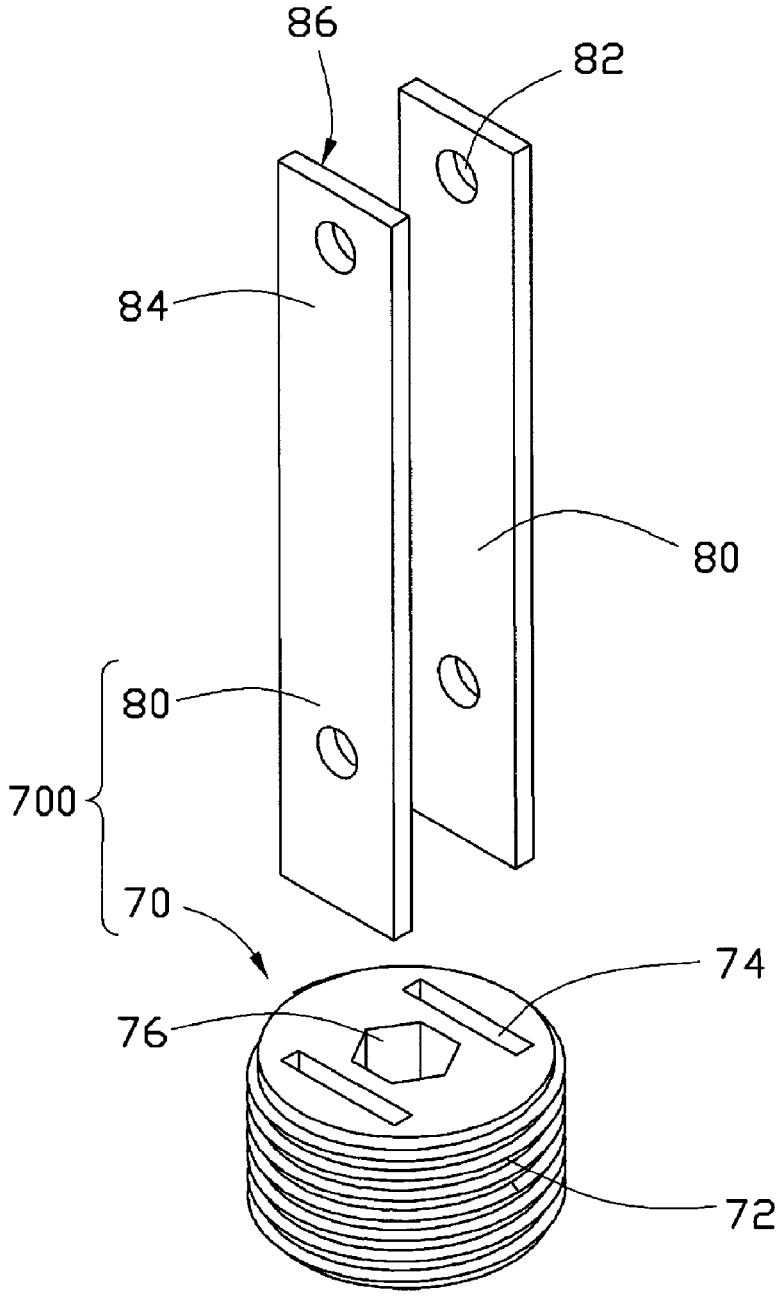
FIG. 7 is an isometric, exploded view of a light engine of an LED illuminator according to alternative embodiment.

FIG. 7 shows a light engine 700 of an LED illuminator according to an alternative embodiment. The light engine 700 includes a mounting seat 70, a pair of heat spreaders 80 and two light sources which are the same as the first embodiment and not shown for simplifying the drawings. In this embodiment, the two heat spreaders 80 are arranged parallel to each other. Each heat spreader 80 is elongated and flat. An elongated, rectangular-shaped mounting surface 84 is formed at one side of the heat spreader 80, and an elongated, rectangular-shaped dissipating surface 86 is formed at another side of the heat spreader 80 opposite to the mounting surface 84. A pair of engaging holes 82 extend from the mounting surface 84 of each heat spreader 80 towards the dissipating surface 86 for assembling one corresponding light source thereon.

The mounting seat 70 of this embodiment forms an external thread 72 on an outer circumferential surface thereof for threadedly engaging with the connecting member 20 to assemble the light engine 700 to the connecting member 20. An opening 76 extends through a central portion of the mounting seat 70 along an axial direction for the conductive wire extending therethrough. A pair of grooves 74 are defined in the mounting seat 70 for receiving bottom ends of the heat spreaders 80. Each groove 74 has a shape matching that of the heat spreader 80, being rectangular and elongated. The two grooves 74 are located at opposite sides of the opening 76, and are parallel to each other. It is to be understood that the shape of the groove 74 should be the same as the heat spreader 80, and must be changed when the shape of the heat spreader 80 changes.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED illuminator, comprising:

a connecting member being cylindrical-shaped and hollow;

a light engine comprising a mounting seat and at least one light source fixed on the mounting seat, the mounting seat being received in and fixed onto the connecting member, the at least one light source extending beyond the connecting member, the at least one light source comprising an elongated circuit board and a plurality of LEDs arranged on the circuit board, the light engine further comprising an elongated heat spreader with one end inserting into the mounting seat, the circuit board of the at least one light source attaching to the heat spreader for transferring heat of the LEDs to the mounting seat and then to the connecting member;

a lamp cover coupling to and sealing one end of the connecting member and receiving the at least one light source therein; and a lamp cap coupling to and sealing an opposite end of the connecting member.

2. The LED illuminator of claim 1, wherein the connecting member forms an internal thread therein, and the mounting seat forms an external thread threadedly engaging with the internal thread of the connecting member.

3. The LED illuminator of claim 2, wherein an annular protrusion extends radially and inwardly from a middle of an inner circumferential surface of the connecting member, the internal thread being formed at an inner circumferential surface of the protrusion.

4. The LED illuminator of claim 3, wherein first and second inner threads are formed on the inner circumferential surface of the connecting member at opposite sides of the protrusion, the lamp cover and the lamp cap each forming an outer thread on an outer circumferential surface thereof threadedly engaging with corresponding inner thread of the connecting member.

5. The LED illuminator of claim 4, wherein a plurality of ribs are formed on the outer circumferential surface of the lamp cover adjacent to the outer thread of the lamp cover.

6. The LED illuminator of claim 4, wherein a plurality of ribs are formed on the outer circumferential surface of the lamp cap adjacent to the outer thread of the lamp cap.

7. The LED illuminator of claim 4, further comprising a sealing ring arranged between the protrusion of the connecting member and the lamp cover to form a fluid-tight sealing between the lamp cover and the connecting member.

8. The LED illuminator of claim 4, further comprising a sealing ring arranged between the protrusion of the connecting member and the lamp cap to form a fluid-tight sealing between the lamp cap and the connecting member.

9. The LED illuminator of claim 3, wherein the connecting member is made of metal or alloy, a plurality of fins being integrally formed on a middle of an outer circumferential surface of the connecting member, the fins are evenly spaced from each other along a circumferential direction of the connecting member, each of the fins extending along an axial direction of the connecting member.

10. The LED illuminator of claim 1, wherein the mounting seat defines an opening in a central portion for extension of conductive wire theretherough to connect the LEDs to a power source, and a plurality of grooves around the opening, the light engine comprising a plurality of heat spreaders fixedly engaging into the grooves, and a plurality of light sources, each light source being fixed on one heat spreader.

11. The LED illuminator of claim 1, wherein a cross section of the heat spreader is rectangular, and the heat spreader comprising a rectangular mounting surface and a rectangular dissipating surface opposite to the mounting surface, the circuit board attaching to the mounting surface.

12. The LED illuminator of claim 1, wherein a cross section of the heat spreader is semi-circular, and the heat spreader comprising a rectangular mounting surface and a curved dissipating surface, the circuit board attaching to the mounting surface.

13. The LED illuminator of claim 1, further comprising a sealing member coupling to and sealing an end of the lamp cap away from the connecting member, the sealing member being made of plastic, and defining a channel with a diameter not larger than that of a conductive wire.

14. An LED illuminator, comprising:

a connecting member being cylindrical-shaped and hollow;

a lamp cover coupling to and sealing a first end of the connecting member;

a plurality of LEDs being received in the lamp cover for generating light to illuminate an outside of the lamp cover;

a hollow lamp cap having a top end coupling to a second end of the connecting member opposite to the first end, and a bottom end defining an aperture for conductive wire extending therethrough; and a sealing member defining an annular slot in an outer circumferential surface thereof, a diameter of the sealing member at the slot being not smaller than that of the aperture of the lamp cap, a portion of the bottom end of the lamp cap around the aperture engaging into the slot of the sealing member, a channel extending through the sealing member with a diameter not larger than the conductive wire.

15. The LED illuminator of claim 14, wherein an annular protrusion extends radially and inwardly from a middle of an inner circumferential surface of the connecting member, first and second inner threads being formed on the inner circumferential surface of the connecting member at opposite sides of the protrusion, the lamp cover and the lamp cap each forming an outer thread on an outer circumferential surface thereof threadedly engaging with corresponding inner thread of the connecting member.

16. The LED illuminator of claim 15, further comprising a mounting seat, a plurality of heat spreaders fixed on the mounting seat, the LEDs being fixed on the heat spreaders, an external thread being formed on an outer circumferential surface of the mounting seat, an internal thread being formed at an inner circumferential surface of the protrusion engaging with the external thread of the mounting seat.

17. The LED illuminator of claim 15, further comprising a first sealing ring arranged between the protrusion and the lamp cover, and a second sealing ring arranged between the protrusion and the lamp cap.

18. An LED illuminator, comprising:

a connecting member being cylindrical-shaped and hollow and comprising an annular protrusion extending radially and inwardly from a middle of an inner circumferential surface thereof, the connecting member forming an internal thread at an inner circumferential surface of the protrusion, and first and second inner threads on the inner circumferential surface of the connecting member at opposite sides of the protrusion;

a light engine comprising a mounting seat and at least one light source fixed on the mounting seat, the mounting seat being received in and fixed onto the connecting member, the at least one light source extending beyond the connecting member, the mounting seat forming an external thread threadedly engaging with the internal thread of the connecting member;

a lamp cover coupling to and sealing one end of the connecting member and receiving the at least one light source therein, the lamp cover forming an outer thread on an outer circumferential surface thereof threadedly engaging with the first inner thread of the connecting member;

a lamp cap coupling to and sealing an opposite end of the connecting member, the lamp cover forming an outer thread on an outer circumferential surface thereof threadedly engaging with the second inner thread of the connecting member; and a sealing ring arranged between the protrusion of the connecting member and the lamp cover to form a fluid-tight sealing between the lamp cover and the connecting member.

* * * * *